US007692516B2

(12) United States Patent
Kim et al.

(10) Patent No.: US 7,692,516 B2
(45) Date of Patent: Apr. 6, 2010

(54) PHASE SHIFTER WITH PHOTONIC BAND GAP STRUCTURE USING FERROELECTRIC THIN FILM

(75) Inventors: Young-Tae Kim, Daejeon (KR); Han-Cheol Ryu, Seoul (KR); Min-Hwan Kwak, Daejeon (KR); Seung-Eon Moon, Daejeon (KR); Su-Jae Lee, Daejeon (KR); Kwang-Yong Kang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 85 days.

(21) Appl. No.: 11/722,299

(22) PCT Filed: Dec. 20, 2005

(86) PCT No.: PCT/KR2005/004390

§ 371 (c)(1),
(2), (4) Date: Nov. 26, 2007

(87) PCT Pub. No.: WO2006/068395

PCT Pub. Date: Jun. 29, 2006

(65) Prior Publication Data

US 2008/0116995 A1 May 22, 2008

(30) Foreign Application Priority Data

Dec. 20, 2004 (KR) ..... 10-2004-0108981

(51) Int. Cl.
*H01P 1/18* (2006.01)
*H01P 3/08* (2006.01)

(52) U.S. Cl. ..... 333/161; 333/138; 333/156; 333/164

(58) Field of Classification Search ..... 333/138, 333/156, 161, 164
See application file for complete search history.

(56) References Cited

U.S. PATENT DOCUMENTS 5,307,003 A * 4/1994 Fairbanks et al. ..... 323/222

(Continued)

FOREIGN PATENT DOCUMENTS

EP 1 170 817 A1 1/2002

(Continued)

OTHER PUBLICATIONS

"Distributed Analog Phase Shifters with Low Insertion Loss"; Authors: Amit S. Nagra, et al.; IEEE Transactions on Microwave Theory and Techniques, vol. 47, No. 9, Sep. 1999.

(Continued)

*Primary Examiner*—Robert Pascal
*Assistant Examiner*—Kimberly E Glenn
(74) *Attorney, Agent, or Firm*—Kile Goekjian Reed & McManus PLLC

(57) ABSTRACT

Provided are a phase shifter with a photonic band gap (PBG) structure using a ferroelectric thin film. The phase shifter includes a microstrip transmission line acting as a microwave input/output line and a plurality of tunable capacitors arranged in the microstrip transmission line at regular intervals. Electrodes disposed on a substrate apply DC voltages to the plurality of tunable capacitors. Radio frequency (RF) chokes and quarter wavelength radial-stubs are connected between the electrodes and the microstrip transmission line in order to prevent high frequency signals from flowing into a DC bias terminal. A plurality of PBGS are periodically arrayed on a ground plane of the substrate.

10 Claims, 6 Drawing Sheets

U.S. PATENT DOCUMENTS

| | | | | |
|---|---|---|---|---|
| 5,923,225 | A * | 7/1999 | De Los Santos | 333/12 |
| 6,531,936 | B1 | 3/2003 | Chiu et al. | |
| 6,559,737 | B1 | 5/2003 | Nagra et al. | |
| 2002/0130734 | A1 * | 9/2002 | Liang et al. | 333/134 |

FOREIGN PATENT DOCUMENTS

| | | |
|---|---|---|
| KR | 1020020004314 | 1/2002 |
| KR | 1020030004221 | 1/2003 |

OTHER PUBLICATIONS

"Uniplanar One-Dimensional Photonic- Bandgap Structures and Resonators"; Authors: Tae-Yeoul Yun and Kai Chang; IEEE Transactions on Microwave Theory and Techniques, vol. 49, No. 3, Mar. 2001.

"Influence of a Metallic Enclosure on the S- Parameters of Microstrip Photonic Bandgap Structures"; Authors: Zhengwei Du, et al.; IEEE Transactions on Electromagnetic Compatiability, vol. 44, No. 2, May 2002.

PCT Written Opinion for International Application No. PCT/KR2005/004390; Date of Mailing: Mar. 31, 2006.

PCT International Search Report for International Application No. PCT/KR2005/004390; Date of Mailing: Mar. 31, 2006.

* cited by examiner

200

PHASE SHIFTER WITH PHOTONIC BAND GAP STRUCTURE USING FERROELECTRIC THIN FILM

CROSS-REFERENCE TO RELATED PATENT APPLICATION

This application claims the benefit of Korean Patent Application No. 10-2004-0108981, filed on Dec. 20, 2004, in the Korean Intellectual Property Office, the disclosure of which is incorporated herein in its entirety by reference.

BACKGROUND OF THE INVENTION

1. Field of the Invention

The present invention relates to a microwave tunable device, and more particularly, to a tunable capacitor using a ferroelectric thin film and a phase shifter using a photonic band gap (PBG) structure.

2. Description of the Related Art

PBG structures were first introduced in the field of optics, but have recently been widely used in high frequency devices such as radio frequency (RF) and microwave devices.

Phase shifters are widely used in microwave systems to steer electron beams and shift the frequency of a radio signal. A phase shifter is an essential component of a phase array antenna system for producing a beam pattern and steering a beam. Phase shifters using a ferroelectric thin film have low manufacturing costs because they are simple to manufacture compared to ferrite/semiconductor phase shifters and provide high switching speed due to high-speed polarization. In particular, because ferroelectric phase shifters have low microwave loss due to the low loss factor of a ferroelectric thin film, much research on ferroelectric phase shifters is being actively conducted to replace conventional ferrite/semiconductor phase shifters that suffer from high microwave loss at higher frequency.

Typical ferroelectric phase shifters are mainly classified into coplanar waveguide (CPW) phase shifters, loaded line phase shifters, and reflective phase shifters including a tunable capacitor mounted at the end of a directional coupler. However, typical phase shifters require many experiments to extract design parameters. Another drawback of phase shifters is that they suffer from large insertion loss variation because characteristic impedance and phase shift vary according to an applied voltage. Thus, there is a need for a phase shifter having a novel structure to overcome the drawbacks.

SUMMARY OF THE INVENTION

The present invention provides a phase shifter with low microwave loss and improved insertion loss and return loss.

According to an aspect of the present invention, there is provided a phase shifter including a microstrip transmission line acting as a microwave input/output line and a plurality of tunable capacitors arranged in the microstrip transmission line at regular intervals. Electrodes are disposed on a substrate to apply DC voltages to the plurality of tunable capacitors. Radio frequency (RF) chokes and $\lambda/4$ radial-stubs are connected between one of the electrodes and the microstrip transmission line in order to prevent high frequency RF signals from flowing into a DC bias terminal. A plurality of PBGS are periodically arrayed in a ground plane of the substrate.

The substrate may be comprised of an oxide single crystal substrate formed of, for example, MgO, $LaAlO_3$, or $Al_2O_3$, a ceramic or high-resistive Si semiconductor substrate, a glass substrate, or a semi-insulating gallium arsenide substrate.

The ferroelectric thin film may be comprised of a dielectric thin film grown from the substrate using one of a pulsed laser ablation method, an RF magnetron sputtering method, a chemical vapor deposition method, and an atomic layer deposition method.

Each of the tunable capacitors may have a planar interdigital (IDT) electrode pattern or a parallel plate electrode pattern. Each of the tunable capacitors may include an etched or non-etched ferroelectric thin film. The PBGs may be comprised of rectangular patterns obtained by etching a ground electrode formed on the substrate.

The phase shifter of the present invention has an optimized combination of microstrip transmission line and tunable capacitors, thus providing improved insertion loss and return loss characteristics. The phase shifter implemented with microstrips is very simple to fabricate and is usable over a wide range of frequencies due to its wide band characteristics. The phase shifter also has an optimized structure including the IDT tunable capacitors and the PBGs, thus providing low microwave loss.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
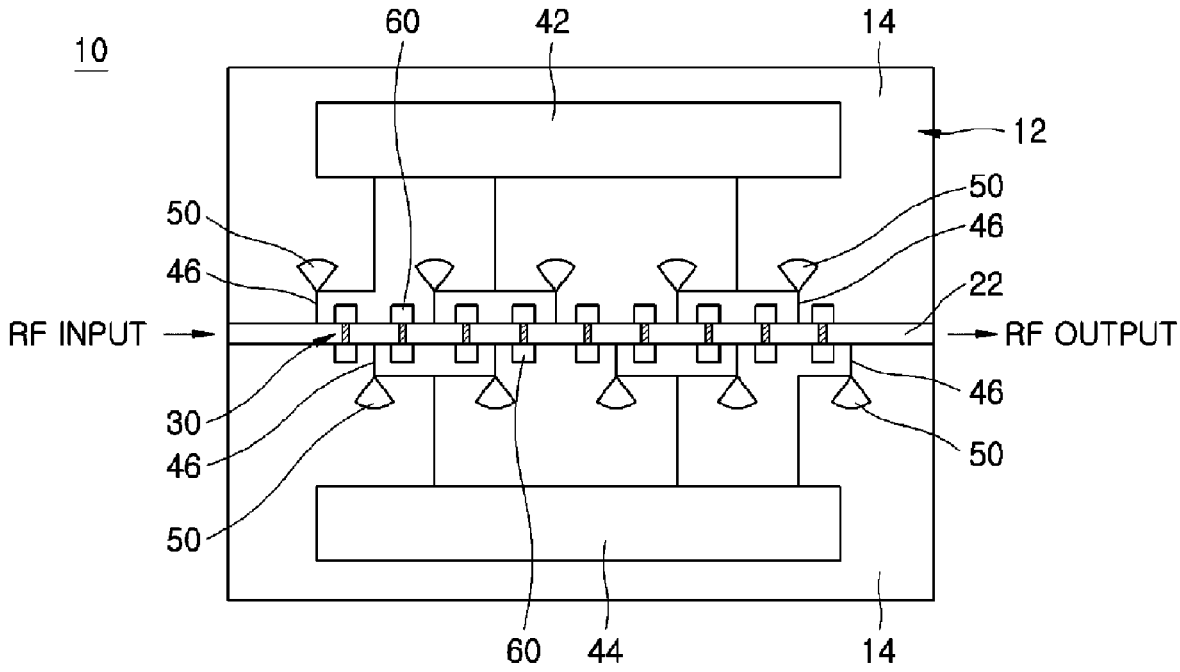
FIG. 1 is a plan view of an analog phase shifter according to a preferred embodiment of the present invention.

FIG. 1 is a plan view of an analog phase shifter 10 according to a preferred embodiment of the present invention. Referring to FIG. 1, the analog phase shifter 10 includes a microstrip transmission line 22 mounted on a substrate 12. The microstrip transmission line 22 acts as a microwave input/output line. The substrate 12 may be comprised of an oxide single crystal substrate formed of, for example, MgO, $LaAlO_3$, or $Al_2O_3$, a ceramic or high-resistive Si semiconductor substrate, a glass substrate, or a semi-insulating gallium arsenide substrate.

Figure 2:
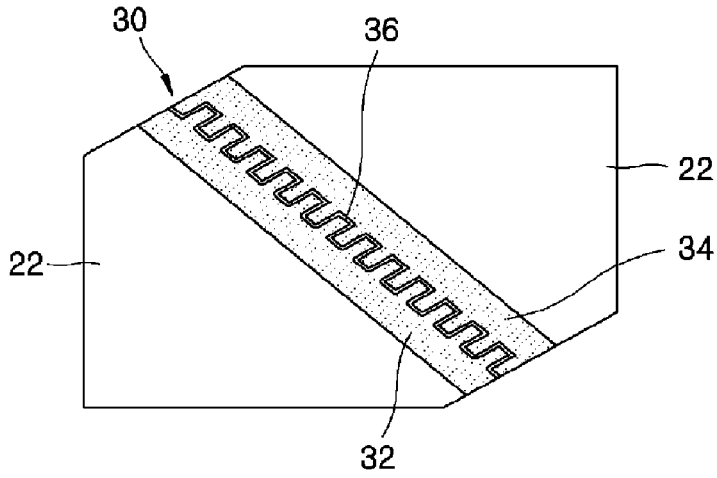
FIG. 2 is an enlarged view of the tunable capacitor for the analog phase shifter of FIG. 1.

A plurality of tunable capacitors 30 are embedded in the microstrip transmission line 22. FIG. 2 is an enlarged view illustrating the detailed configuration of each tunable capacitor 30. The tunable capacitor 30 has an IDT pattern with a ferroelectric thin film 36 between first and second conductive layers 32 and 34. The ferroelectric thin film 36 is formed of a ferroelectric material typically used in this field. The ferroelectric thin film 36 may be formed of barium strontium titanate (BST). The ferroelectric thin film 36 may be formed of a typical ferroelectric material whose dielectric constant varies according to an externally applied voltage on the substrate 12 to a thickness of 0.01-1 μm using a typical film growth method such as a pulsed laser ablation method, a sol-gel method, a radio frequency (RF) magnetron sputtering method, a chemical vapor deposition method, and an atomic layer deposition method.

Electrodes 42 and 44 are disposed on the substrate 12 and apply DC voltages to the plurality of tunable capacitors 30.

RF chokes 46 and quarter wavelength (λ/4) radial-stubs 50 are connected between the microstrip transmission line 22 and either one of the electrodes 42 and 44 in order to apply DC voltages from the electrodes 42 and 44 to the tunable capacitors 30. The RF chokes 46 and the λ/4 radial-stubs 50 efficiently prevent RF signals from flowing into a DC bias terminal, thus protecting the phase shifter 10 against external factors.

A ground electrode (not shown) is formed on a ground plane of the substrate.

The microstrip transmission line 22, the electrodes 42 and 44, the RF chokes 46, the λ/4 radial-stubs 50, and the ground electrode may be easily formed using a typical photolithography method. The microstrip transmission line 22, the electrodes 42 and 44, the RF chokes 46, the λ/4 radial-stubs 50, and the ground electrode may be comprised of a single metallic layer formed of a metal selected from the group consisting of Au, Ag, Al, Cu, Cr, and Ti or may be comprised of a multi-layered metallic layer formed of at least two metals selected from the group consisting of Au, Ag, Al, Cu, Cr, and Ti. The microstrip transmission line 22, the electrodes 42 and 44, the RF chokes 46, the λ/4 radial-stubs 50, and the ground electrode may be formed to be about 3 times thicker than the skin depth of microwaves.

A plurality of photonic band gaps (PBGs) 60 are periodically arrayed on the ground plane of the substrate 12. The plurality of PBGs 60 have rectangular patterns obtained by etching the substrate 12.

As described above, the phase shifter 10 includes the plurality of tunable capacitors 30 using the ferroelectric thin film and a PBG structure consisting of rectangular patterns regularly etched in the ground plane of the substrate 12. A method for fabricating the ferroelectric phase shifter 10 with the PBG structure includes depositing the ferroelectric thin film 36 on the substrate 12, removing a portion of the ferroelectric thin film 36 excluding a portion of the ferroelectric thin film 36 corresponding to the tunable capacitors 30 by etching, depositing Au/Cr to form a microstrip pattern, forming the microstrip transmission line 22 and the tunable capacitors 30 with the first and second conductive layers 32 and 34 that have capacitance that changes due to voltages applied, and creating regularly etched rectangular patterns in the ground plane of the substrate to form the PBGs 60. Here, none of the portions of the ferroelectric thin film 36 may not be etched from the substrate 12.

In the phase shifter 10 illustrated in FIGS. 1 and 2, the microwave input/output line is in the form of a microstrip to facilitate impedance matching. Furthermore, the tunable capacitor 30 has an IDT pattern to facilitate application of DC voltage and a manufacturing process. In this way, the phase shifter has the IDT ferroelectric tunable capacitors 30 arranged at regular intervals in the microstrip transmission line 22 carrying microwaves, thus introducing a phase shift due to changes in capacitance.

Figure 3:
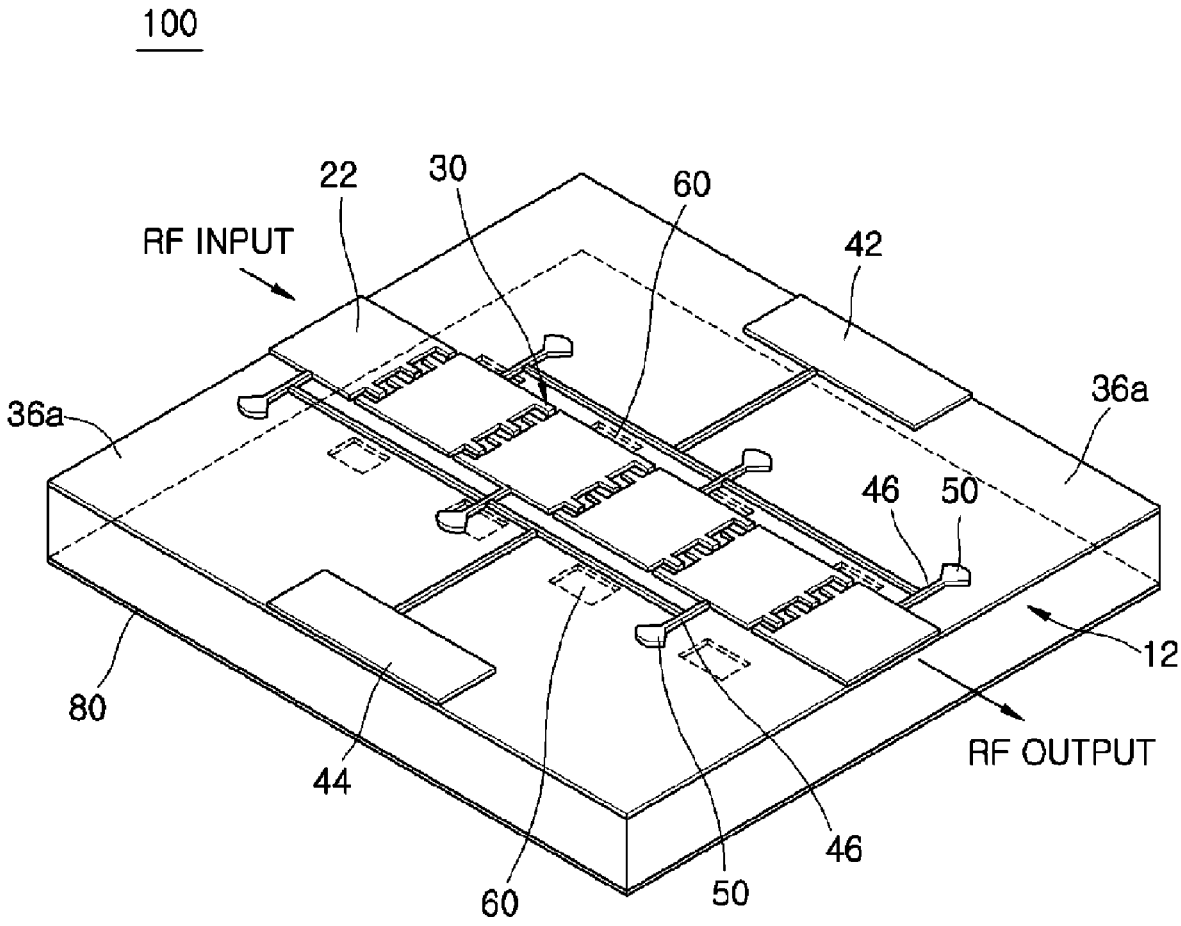
FIG. 3 is a perspective view of a phase shifter according to an exemplary embodiment of the present invention.

FIG. 3 is a perspective view of a phase shifter 100 according to an exemplary embodiment of the present invention. In FIGS. I through 3, like reference numerals represent like elements, and thus, their detailed descriptions will be skipped.

Referring to FIG. 3, a ferroelectric thin film **36*a* is formed on the entire surface of a substrate 12. A plurality of rectangular PBGs 60 are periodically arrayed. The distance between pairs of adjacent PBGs 60 is the same as the distance between pairs of adjacent tunable capacitors 30. The rectangular PBGs 60 are located directly under the tunable capacitors 30**.

A ground electrode 80 is formed on a backside of the substrate 12. The ground electrode may be formed using a typical photolithography method.

Figure 4:
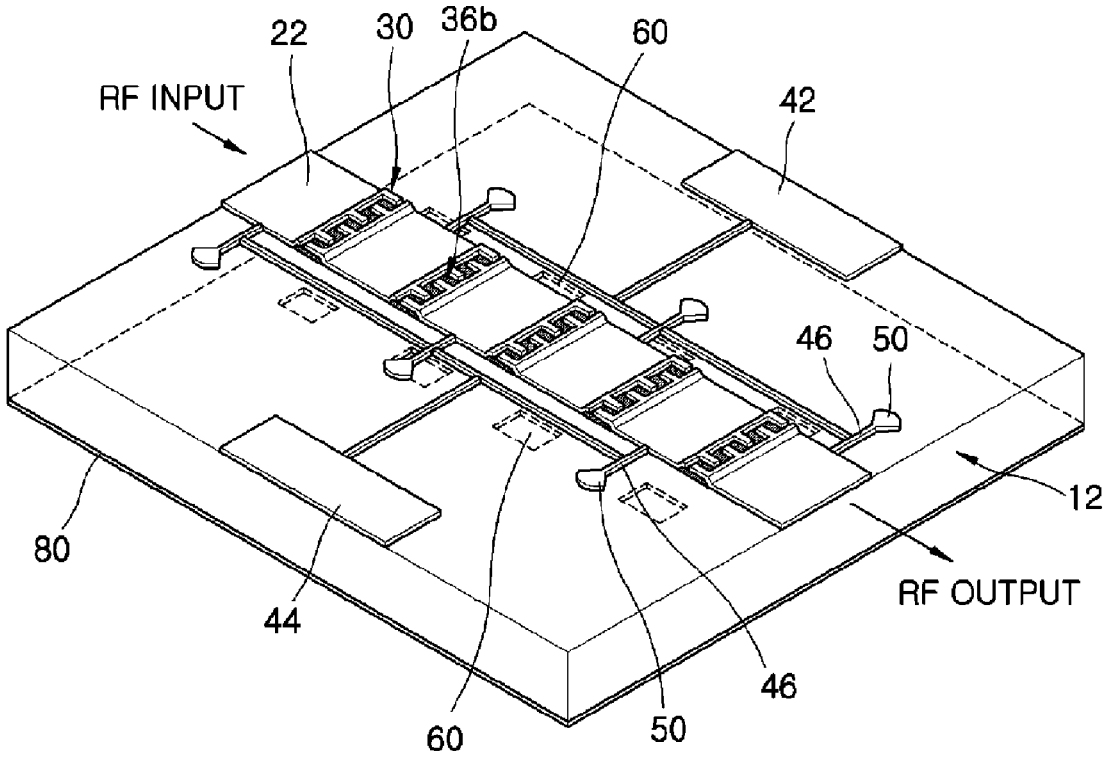
FIG. 4 is a perspective view of a phase shifter according to another exemplary embodiment of the present invention.

FIG. 4 is a perspective view of a phase shifter 200 according to another exemplary embodiment of the present invention. In FIGS. 1 through 4, like reference numerals represent like elements, and thus, their detailed descriptions will be skipped.

Referring to FIG. 4, a ferroelectric thin film **36*b* may be formed on a portion of a substrate 12 corresponding to a plurality of tunable capacitors 30 in order to reduce insertion loss of the phase shifter 200. The ferroelectric thin film 36*b* may be formed by depositing a ferroelectric material on the entire surface of the substrate 12 and etching the ferroelectric material using, for example, a typical physical/chemical etching method, such that it can be left only on the portion of the substrate 12 corresponding to the tunable capacitors 30**.

The tunable capacitors 30 are formed on a microstrip transmission line 22 as a periodic array. The tunable capacitors 30 may have a planar IDT electrode structure or a parallel plate electrode structure. The material of the tunable capacitors 30 has already been described above with reference to FIG. 1.

A periodic array of PBGs 60 may be formed to be rectangular by etching a ground electrode formed on the substrate 12. The distance between a pair of adjacent PBGs 60 is the same as the distance between a pair of adjacent tunable capacitors 30. The PBGs 60 are located directly under the tunable capacitors 40.

Figure 5:
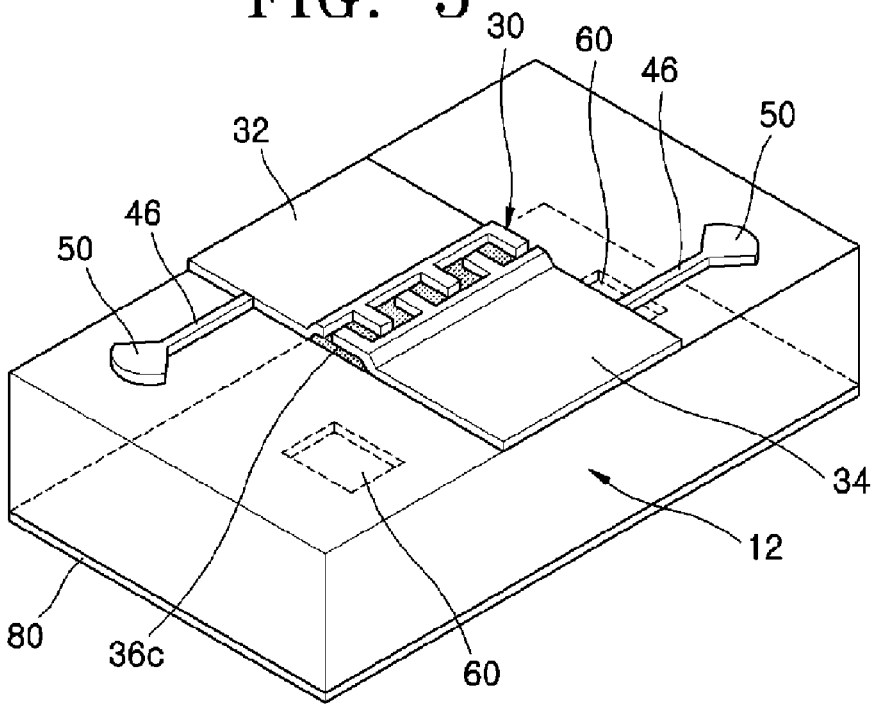
FIG. 5 is a perspective view of a phase shifter according to another exemplary embodiment of the present invention.
Figure 6:
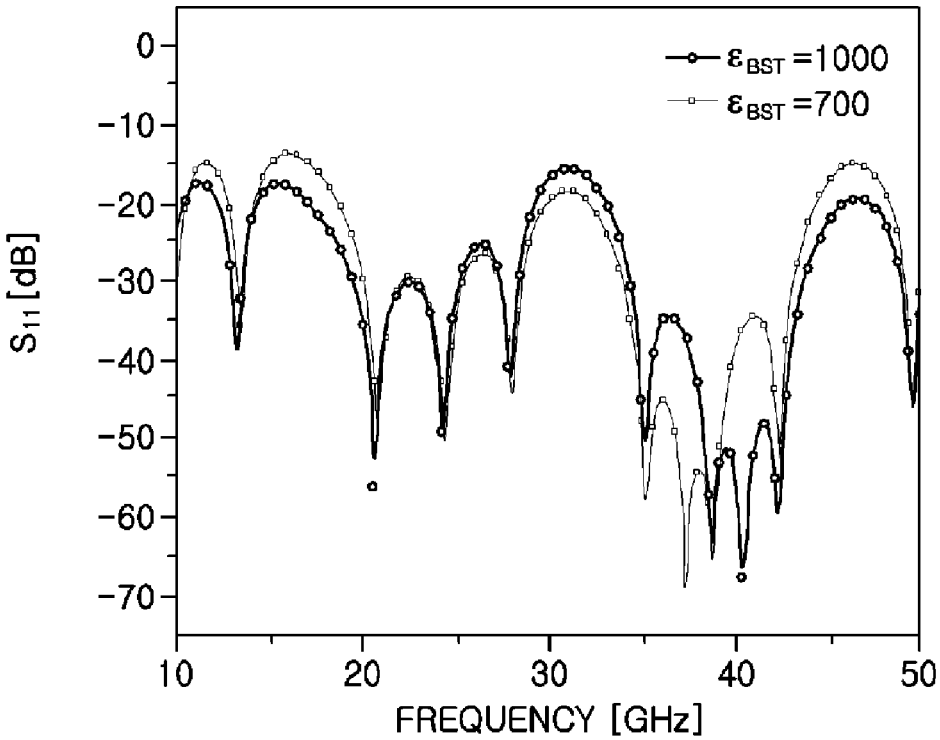
FIG. 6 is a graph illustrating return loss with respect to the dielectric constant of a ferroelectric thin film in a tunable capacitor for an analog phase shifter according to an embodiment of the present invention.
Figure 7:
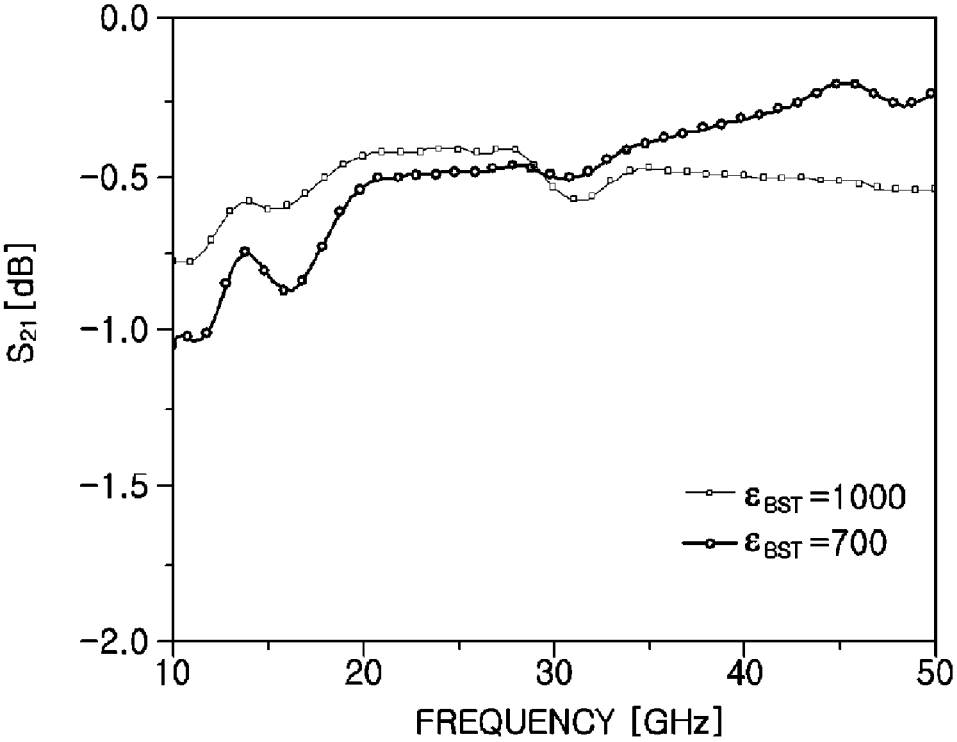
FIG. 7 is a graph illustrating insertion loss with respect to the dielectric constant of a ferroelectric thin film in a tunable capacitor for an analog phase shifter according to an embodiment of the present invention.
Figure 8:
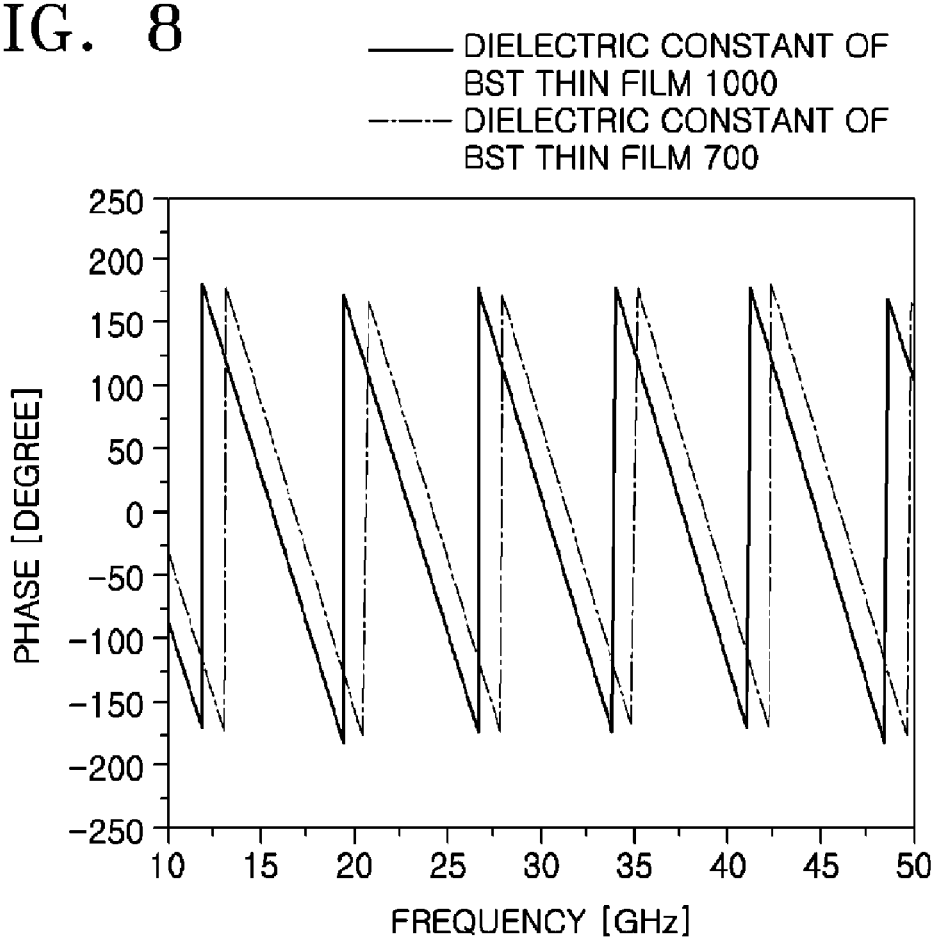
FIG. 8 is a graph illustrating differential phase shift angle with respect to the dielectric constant of a ferroelectric thin film in a tunable capacitor for an analog phase shifter according to an embodiment of the present invention.

FIG. 5 is a perspective view of a phase shifter 300 according to another exemplary embodiment of the present invention. In FIGS. 1 through 5, like reference numerals represent like elements, and thus, their detailed description will be skipped.

Referring to FIG. 5, a ferroelectric thin film 36c may be formed on a portion of a substrate 12 corresponding to a space between a first conductive layer 32 and a second conductive layer 34 of a tunable capacitor 30, thereby forming a planar IDT architecture or a parallel plate architecture. Alternatively, the ferroelectric thin film 36c may be formed on the entire surface of the substrate 12.

A plurality of PBGs 60 are located directly under the tunable capacitor 30 and are formed to be rectangular by etching a ground electrode 80 formed on the substrate 12.

The ferroelectric phase shifters 10, 100, 200, and 300 have an optimized structure including the IDT tunable capacitors 30 and the PBGs 60, thus providing low microwave loss.

FIGS. 3-5 are graphs illustrating the result of electromagnetic simulations using High Frequency Simulator (HFSS) conducted to verify the characteristics of a phase shifter according to an embodiment of the present invention. More specifically, FIGS. 3-5 are graphs respectively illustrating return loss $S_{11}$, insertion loss $S_{21}$, and differential phase shift angle with respect to dielectric constant E of a ferroelectric thin film in a tunable capacitor for a phase shifter according to an embodiment of the present invention.

In the simulations, a BST thin film is used as the ferroelectric thin film in the tunable capacitor and return loss $S_{11}$, insertion loss $S_{21}$, and differential phase shift angle were measured when the dielectric constant of the BST thin film is 1000 and 700, respectively. Considering the worst case, the dielectric loss tangent of the ferroelectric thin film was fixed to 0.1 regardless of changes in the dielectric constant. As evident from FIGS. 3-5, the tunable capacitor has return losses $S_{11}$ of −16 dB and −20 dB, an insertion loss of less than −0.6 dB, and a differential phase change angle of 60° at 30 GHz when the dielectric constant of the ferroelectric thin film is 1000 and 700, respectively.

Figure 9:
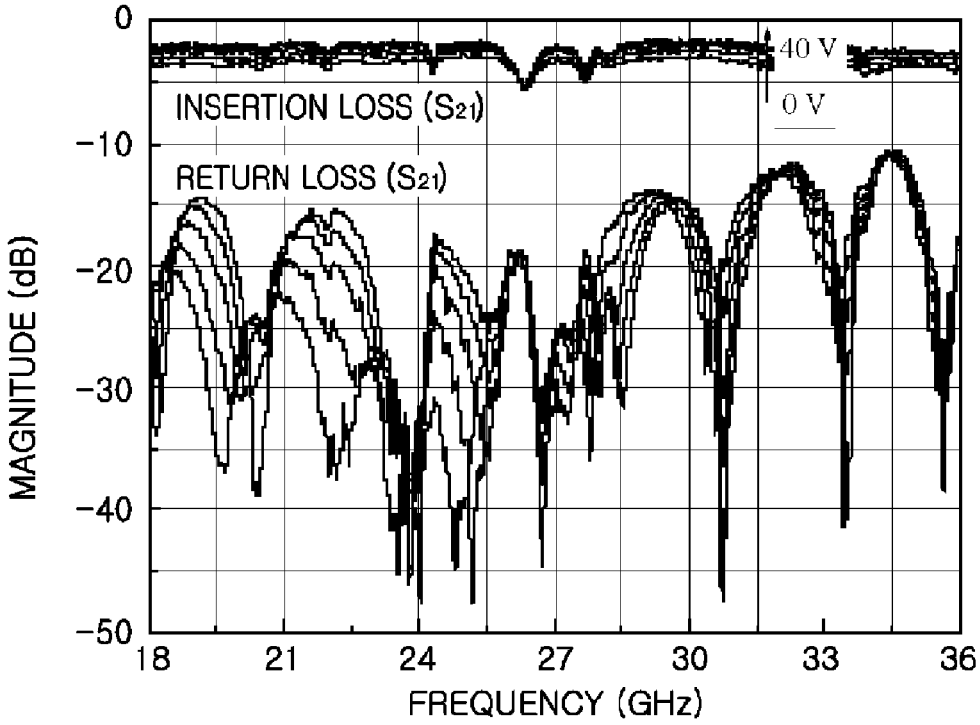
FIG. 9 is a graph illustrating the variations of return loss ($S_{11}$) and insertion loss ($S_{21}$) of a ferroelectric phase shifter having a photonic band gap (PBG) structure according to an exemplary embodiment of the present invention, with respect to a DC voltage applied to the ferroelectric phase shifter and the frequency at which the ferroelectric phase shifter operates.

FIG. 9 is a graph illustrating the variations of return loss ($S_{11}$) and insertion loss ($S_{21}$) of a ferroelectric phase shifter having a PBG structure according to an exemplary embodiment of the present invention, with respect to a DC voltage applied to the ferroelectric phase shifter and the frequency at which the ferroelectric phase shifter operates. A tunable IDT capacitor of the ferroelectric phase shifter was manufactured by etching a ferroelectric epitaxial BST thin film grown from a MgO single crystal substrate. Referring to FIG. 9, the ferroelectric phase shifter offers excellent microwave characteristics, including low return loss and minute fluctuations in insertion loss ($S_{21}$) throughout a wide band of 18-35 GHz.

Figure 10A:
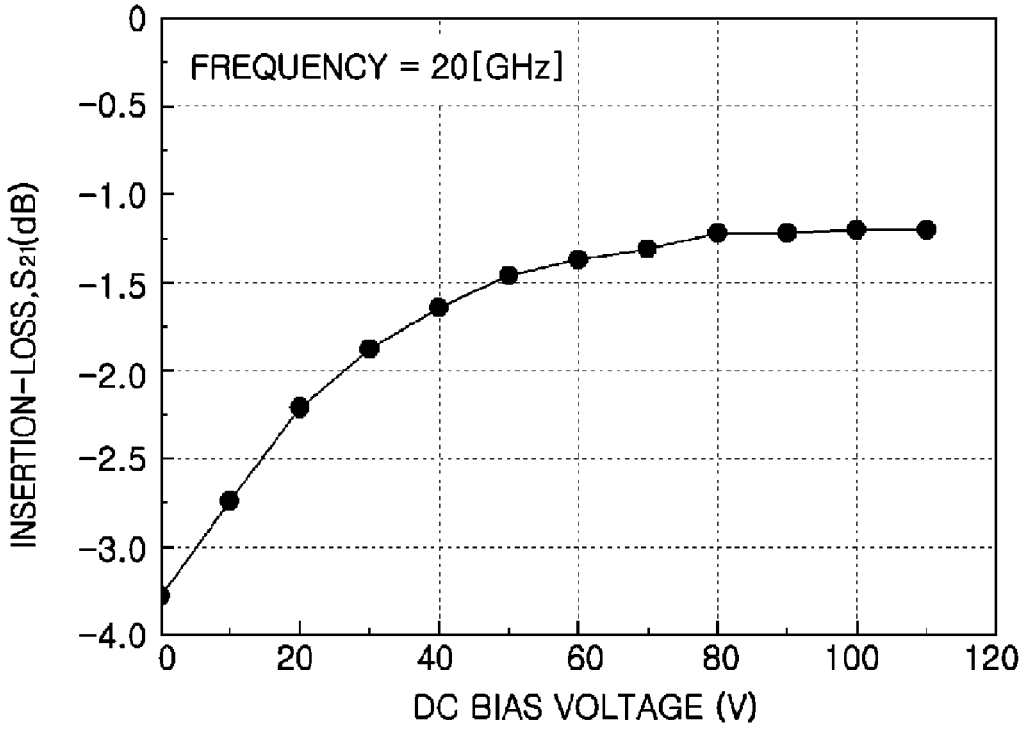
FIG. 10A is a graph illustrating the variation of insertion loss ($S_{21}$) of a ferroelectric phase shifter having a PBG structure according to an exemplary embodiment of the present invention, with respect to a DC voltage applied to the ferroelectric phase shifter when the ferroelectric phase shifter operates at a frequency of 20 GHz.

FIG. 10A is a graph illustrating the variation of insertion loss ($S_{21}$) of a ferroelectric phase shifter having a PBG structure according to an exemplary embodiment of the present invention, with respect to a DC voltage applied to the ferroelectric phase shifter when the ferroelectric phase shifter operates at a frequency of 20 GHz. Referring to FIG. 10A, when the ferroelectric phase shifter operates at a frequency of 20 GHz and a DC voltage of 110 V is applied to the ferroelectric phase shifter, the ferroelectric phase shifter offers a maximum insertion loss of −3.3 dB and a return loss of −23 dB.

Figure 10B:
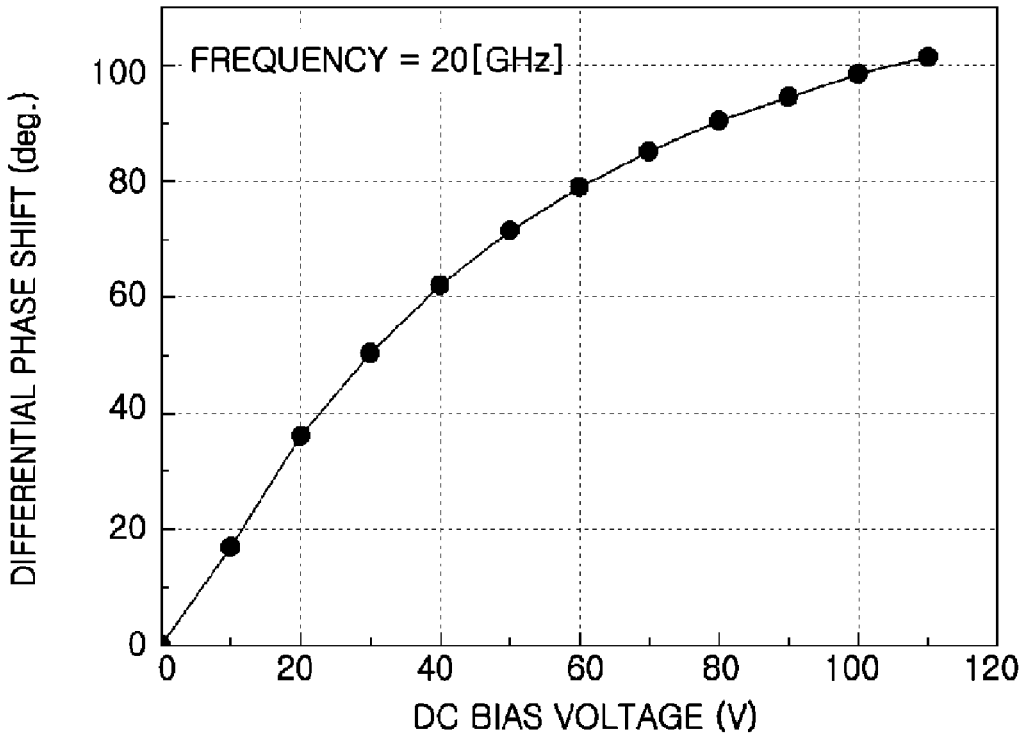
FIG. 10B is a graph illustrating the variation in the differential phase shift characteristic of a ferroelectric phase shifter having a PBG structure according to an exemplary embodiment of the present invention, with respect to a DC voltage applied to the ferroelectric phase shifter when the ferroelectric phase shifter operates at a frequency of 20 GHz.

FIG. 10B is a graph illustrating the variation in the differential phase shift characteristic of a ferroelectric phase shifter having a PBG structure according to an exemplary embodiment of the present invention, with respect to a DC voltage applied to the ferroelectric phase shifter when the ferroelectric phase shifter operates at a frequency of 20 GHz. Referring to FIG. 10B, when the ferroelectric phase shifter operates at a frequency of 20 GHz and a DC voltage of 110 V is applied to the ferroelectric phase shifter, the ferroelectric phase shifter offers a differential phase shift of 103°.

A phase shifter of the present invention includes a transmission line in microstrip form that facilitates impedance matching, an array of IDT ferroelectric tunable capacitors formed in the transmission line, and PBGs arranged at regular intervals in a ground plane. The phase shifter of the present invention changes the dielectric constant of a ferroelectric thin film due to a DC voltage applied and changes phase of an input signal due to change in capacitance.

A phase shifter of the present invention has an optimized combination of microstrip transmission line and tunable capacitors, thus providing improved insertion loss and return loss characteristics. The phase shifter implemented with microstrips is very simple to fabricate and is usable over a wide range of frequencies due to its wide band characteristics. The phase shifter also has an optimized structure including the IDT tunable capacitors and the PBGs, thus providing low microwave loss.

While the present invention has been particularly shown and described with reference to exemplary embodiments thereof, it will be understood by those of ordinary skill in the art that various changes in form and details may be made therein without departing from the spirit and scope of the present invention as defined by the following claims.

The present invention can be applied to microwave tunable devices such as phase shifters using ferroelectric tunable capacitors and PBG structures. The phase shifter of the present invention provides improved insertion loss and return loss characteristics through an optimized combination of microstrip transmission line and tunable capacitors and can be implemented with microstrip structure.

What is claimed is:

1. A phase shifter comprising:

a substrate;

a microstrip transmission line that is mounted on the substrate and acts as a microwave input/output line;

a plurality of tunable capacitors arranged in the microstrip transmission line at regular intervals;

electrodes that are mounted on the substrate and apply DC voltages to the plurality of tunable capacitors;

Radio Frequency (RF) chokes and quarter wavelength radial-stubs connected between the electrodes and the microstrip transmission line; and a plurality of Photonic Band Gaps (PBGs) periodically arrayed in a ground plane of the substrate.

2. The phase shifter of claim 1, wherein each of the tunable capacitors has an interdigital (IDT) pattern or a parallel type electrode pattern.

3. The phase shifter of claim 2, wherein each of the tunable capacitors is comprised of a single metallic layer formed of a metal selected from the group consisting of Au, Ag, Al, Cu, Cr, and Ti or a multi-layered metallic layer formed of at least two metals selected from the group consisting of Au, Ag, Al, Cu, Cr, and Ti.

4. The phase shifter of claim 1, wherein each of the tunable capacitors includes a ferroelectric thin film.

5. The phase shifter of claim 4, wherein the ferroelectric thin film is formed on the entire surface of the substrate.

6. The phase shifter of claim 4, wherein the ferroelectric thin film is formed on a portion of the substrate corresponding to the tunable capacitors.

7. The phase shifter of claim 4, wherein the ferroelectric thin film is formed of Barium Strontium Titanate (BST).

8. The phase shifter of claim 1 further comprising a ground electrode which is formed on the ground plane of the substrate, wherein the plurality of PBGs are comprised of rectangular patterns formed by etching the ground electrode.

9. The phase shifter of claim 1, wherein each of the electrodes is comprised of a single metallic layer formed of a metal selected from the group consisting of Au, Ag, Al, Cu, Cr, and Ti or a multi-layered metallic layer formed of at least two metals selected from the group consisting of Au, Ag, Al, Cu, Cr, and Ti.

10. The phase shifter of claim 1, wherein the microstrip transmission line is comprised of a single metallic layer formed of a metal selected from the group consisting of Au, Ag, Al, Cu, Cr, and Ti or a multi-layered metallic layer formed of at least two metals selected from the group consisting of Au, Ag, Al, Cu, Cr, and Ti.

* * * * *